United States Patent [19]

Behrendt

[11] Patent Number: 4,807,936

[45] Date of Patent: Feb. 28, 1989

[54] LOUNGE CHAIR RIB CUSHION

[76] Inventor: Douglas Behrendt, 342 Hayes Ave., Holland, Mich. 49423

[21] Appl. No.: 95,358

[22] Filed: Sep. 10, 1987

[51] Int. Cl.[4] ..... A47C 7/00

[52] U.S. Cl. ..... 297/445; 297/DIG. 1; 297/463; 248/345.1

[58] Field of Search ..... 297/445, DIG. 1, 488, 297/5, 461, 446, 219, 463, 457; 248/345.1

[56] References Cited

U.S. PATENT DOCUMENTS

| | | | |
|---|---|---|---|
| 2,251,318 | 8/1941 | Blair et al. | 297/DIG. 1 |
| 2,644,776 | 7/1953 | Williams et al. . | |
| 2,838,100 | 6/1958 | Follows | 297/DIG. 1 |
| 3,358,725 | 12/1967 | Bussard et al. | 248/345.1 |
| 3,506,307 | 4/1970 | Kahle | 297/446 |
| 3,583,761 | 6/1971 | Hume et al. | 297/488 |
| 3,634,925 | 1/1972 | Van Loo | 248/345.1 |
| 3,884,495 | 5/1975 | Petock | 297/5 |
| 3,941,159 | 3/1976 | Toll | 138/147 |
| 4,109,887 | 8/1978 | Wakeland | 248/345.1 |
| 4,280,731 | 7/1981 | Pitts et al. | 297/488 |
| 4,508,384 | 4/1985 | Castelot et al. | 297/284 |

*Primary Examiner*—Francis K. Zugel

*Attorney, Agent, or Firm*—John A. Waters

[57] ABSTRACT

A cushion for support ribs of tubular furniture comprising a flexible cushioning construction formed in an elongated shape and with a continuous saw tooth seat on one side running from end to end lengthwise and extending inwardly towards a central cavity that similarly extends lengthwise from end to end. The central cavity is of a suitable diameter to envelope and snugly engage the support ribs, with the overall dimensions of the cushion being compatible with installation on support ribs of tubular furniture insofar as clearance between said ribbing and adjacent webbing, and as to overall length. The outer configuration of the cushion may be provided with a cosmetic appearance of an animal such as an alligator or other whimsical likeness.

8 Claims, 5 Drawing Sheets

LOUNGE CHAIR RIB CUSHION

BACKGROUND OF THE INVENTION

This invention relates to a rib cushion designed to fit over underlying support ribs of lawn furniture such as reclining lounge chairs.

Typical lawn furniture employs a flexible body support material, such as flexible plastic tubing or the like suspended on a rigid frame. The usage of lightweight furniture employing flexible plastic tubing as the support material ("tubular furniture") is highly appropriate for outdoor lounging, since it is portable, inexpensive, weather resistant, and requires very little storage space, all of which are desirable factors given the seasonally variable climates in parts of the country. The usage of tubular furniture is being extended to the inside of the home where contemporary tastes have adopted the lightweight tubular products for year round use.

A consistent complaint often heard concerning tubular furniture is its lack of comfort, particularly with respect to certain underlying support ribs used in typical reclining lounge chairs. This in the face of ever increasing popularity has resulted in a need for creative approaches in improving the comfortable usage of such a product. The present invention fills a void that exists in the market place notwithstanding the fact that there has been a long felt and commonly expressed need for such a development. Nothing has been offered to fulfill this need until the present invention.

One problem with a typical reclining chaise lounge type of lawn chairs employing a tubular covering material is that the user frequently cannot lay face down on the furniture without additional cushioning of the support ribs. One only partially successful method of overcoming this problem has been to drape a blanket or pillow across that portion of the chaise lounge to affect a similar result as that accomplished by the present invention.

An object of the present invention is to provide an attractive cushion specifically designed to cushion the support ribs on such furniture.

SUMMARY OF THE INVENTION

In accordance with the present invention, a cushion that covers a support rib in a reclining lounge chair or the like, wherein a flexible body support material is suspended from a rigid frame, comprises a flexible cushioning material which is prepared in an elongated shape having a lengthwise incision or slot extending from end to end and where this incision connects with an interior cavity that similarly extends lengthwise, end to end, somewhat near the center of the cushion. The cavity is of such dimension that it is capable of enclosing and surrounding the support rib making the cushion resistant to removal without force. The width of the cushion is compatible with installation within the framework of a piece of tubular furniture. Generally this requires the cushion to be equal to or slightly less than the width of the frame being spanned by the support rib. The thickness of the cushion is such that it cushions the user from uncomfortable engagement with the support rib when the flexible support material sags under the weight of the user.

The cushion itself can be constructed from a foam or expanded plastic material such that it exhibits a degree of flexibility necessary for installation and generally imparts some feeling of softness to a covered rib.

In addition, the cushion can be made as an inflatable construction. Conventional methods can be employed in the manufacturing of the cushion and as such are not part of the present invention.

The cushion can be formed in such a way as to suggest a likeness or to affect a cosmetic appearance. Whimsical appearances can be employed such that outward configurations mimic animal shapes or other recognizable forms.

In whatever final form, the installed cushion is utilized wherever a supporting rib traverses the frame of the furniture and interferes with the maximum enjoyment of the furniture by presenting an uncomfortable zone of contact. The present invention therefore operates to transition the occupant's contact between areas of webbing with as little discomfort as possible.

These and other advantages and features of the present invention will hereinafter appear and for purposes of illustration but not of limitation a preferred embodiment of the present invention is described in detail below and shown in the appended drawings.

BRIEF DESCRIPTIONS OF THE DRAWINGS

DESCRIPTION OF THE PREFERRED EMBODIMENT

Figure 1:
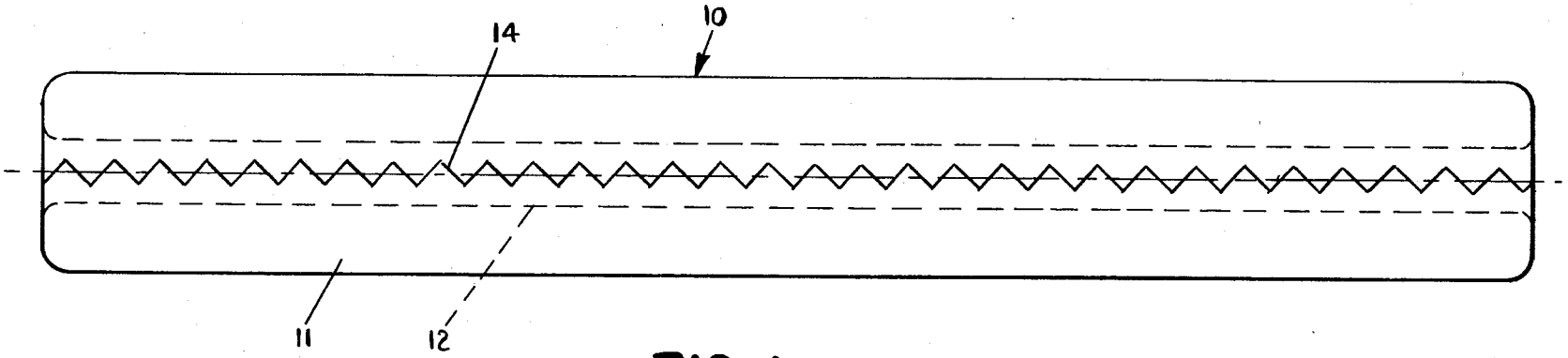
FIG. 1 is a side elevational view of the lounge chair cushion of the present invention.
Figure 2:
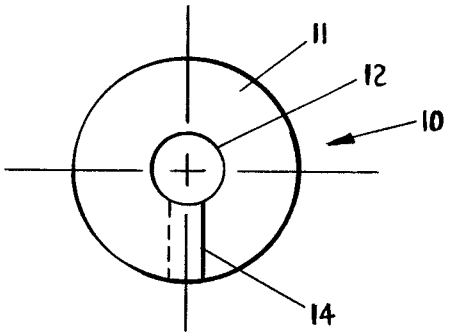
FIG. 2 is an end view of the cushion of FIG. 1.
Figure 3:
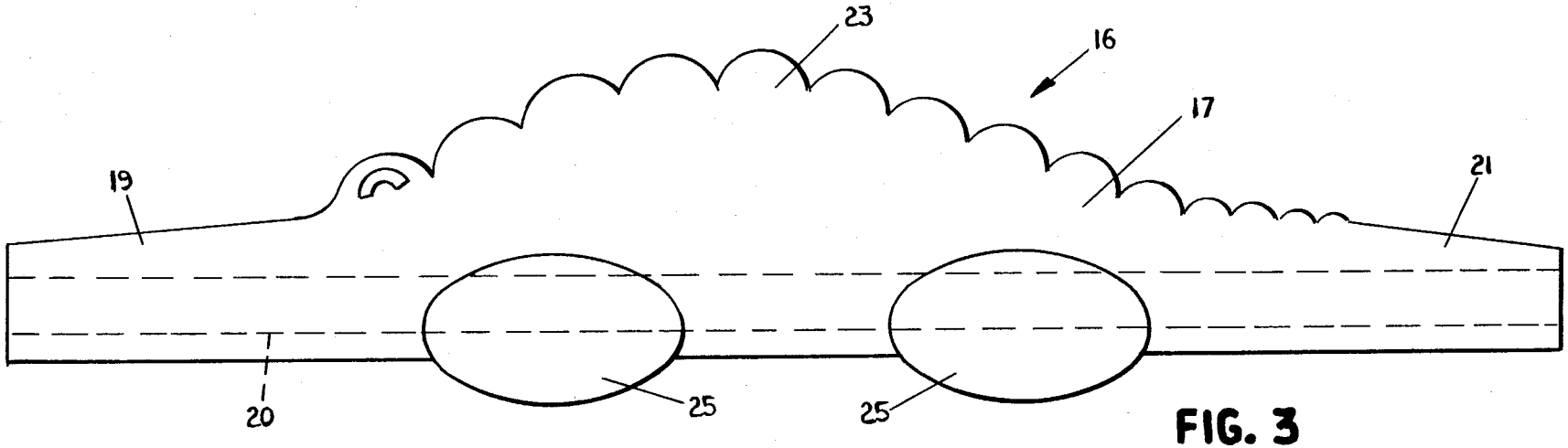
FIG. 3 is a side view of a foamed plastic or rubber cushion formed in an alligator likeness.
Figure 4:
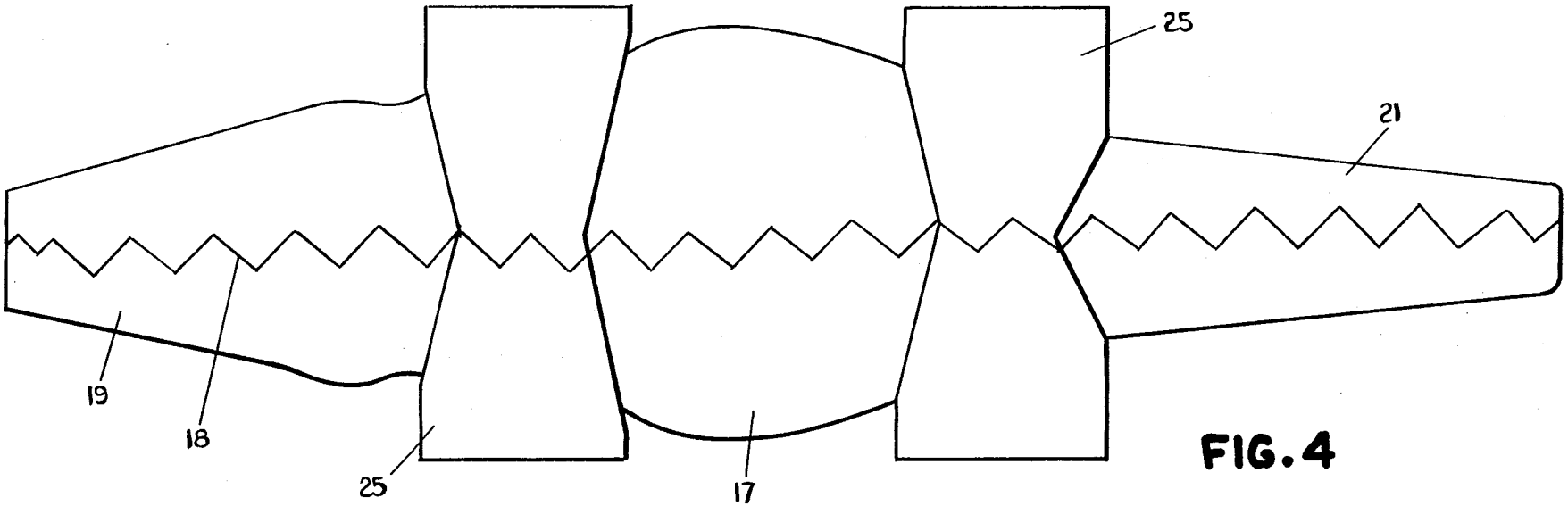
FIG. 4 is a bottom elevational view of a cushion formed in an alligator likeness.
Figure 5:
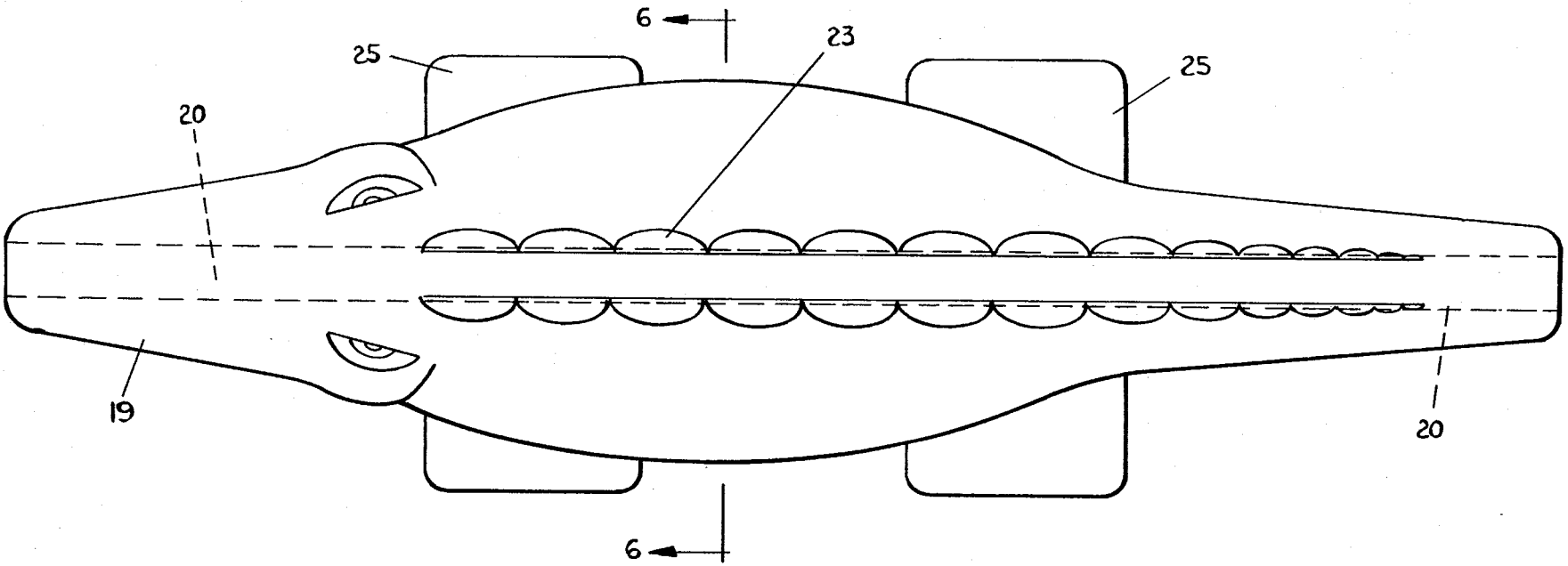
FIG. 5 is a top plan view of a foamed plastic or rubber cushion formed in an alligator likeness.
Figure 6:
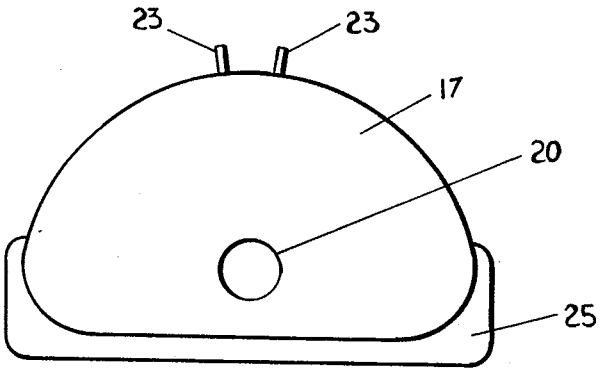
FIG. 6 is a sectional view taken along line 6—6 of FIG. 5.

Referring now to FIG. 1, a flexible cushion 10 for covering supporting ribs in lawn furniture comprises an elongated body 11 having a cavity or elongated internal opening therethrough 12 and a slot or incision 14 in the side of the cushion that extends the length of the cushion and leads to the internal opening. In this embodiment, the shape of the cushion is in the form of a hollow cylinder with a central bore slightly larger than the diameter of the support rib. When the cushion is to be used on a support rib having an outside diameter of approximately 0.5 inches, the opening diameter is approximately five-eighths ($\frac{5}{8}$) inches. The opening is centered within the cylinder, and the cylinder remains essentially symmetrical about its central longitudinal axis, except for the location of slot 14.

In this embodiment, the outer diameter of the cushion measures approximately two (2) inches. Slot 14 extends completely from one end of the cushion to the other in a lengthwise fashion. Although the slot could consist of a straight line cut, in the preferred embodiment it is developed with a zig zag pattern in order to assist with the retention of the cushion on the supporting rib. In this embodiment, the incision cut to form the slot is no wider than 0.06 inches and extends completely through the material of the cushion to the interior cavity 12.

The cushion may be constructed from any material exhibiting sufficient flexibility to withstand installation on the support rib, while at the same time resulting in a cushioning effect insofar as the end user is concerned. The preferred materials consist of a selection from one of the available plastics. Many of the plastics exhibit the requisite qualities and allow for ease of manufacturing via molding or extrusion. The plastic of choice is an expanded foam polyurethane which results in a product that is highly resilient and very flexible yet sturdy enough for the intended application. A closed cell foam is desirable because it resists water absorption.

In the preferred embodiment, the length of the cushion may range from fifteen (15) inches to twenty-two (22) inches overall. The length in actual usage will be determined in a large part by the construction of the particular lawn chair the cushion will be installed upon. It is feasible for the end user to modify the cushion by cutting it to a desired length for a particular application without doing any damage to the underlying features.

The present invention may be formed with different colorations, patterns, or textures without interfering with the fundamental characteristics.

Turning now to FIGS. 3–6, a second embodiment of the present invention is shown in the form of a simulated animal likeness, which is in this case an alligator or crocodile 16. The selection of a whimsical or decorative appearance for the cushion increases the variability of expression in the use of the product.

As can be seen in FIGS. 3–6, the basic elements are retained. The animal has an elongated body 17, preferably formed of foamed polyurethane, and includes a nose 19, a tail 21, fins 23 on the top, and legs or feet 25 on the bottom. A lengthwise saw tooth or straightline opening 18 is formed on the underside of the alligator, and a cavity 20 in the form of an elongated opening extends the length of the alligator in a position that is somewhat central to the overall mass of the cushion. The important aspect is that there is a sufficient thickness of cushion adjacent the user to cushion the support rib of the lawn furniture (see FIG. 8).

The diameter of the opening in this embodiment is the same as that for the previous embodiment, five-eighths ($\frac{5}{8}$) inches. The incision cut likewise displaces 0.06 inches and traverses the cushion lengthwise and completely from end to end. The outer diameter of the configuration in the present embodiment cannot be defined with specificity other than its dependence on the relationship of the configuration to the clearance allowed in the intended application.

Figure 8:
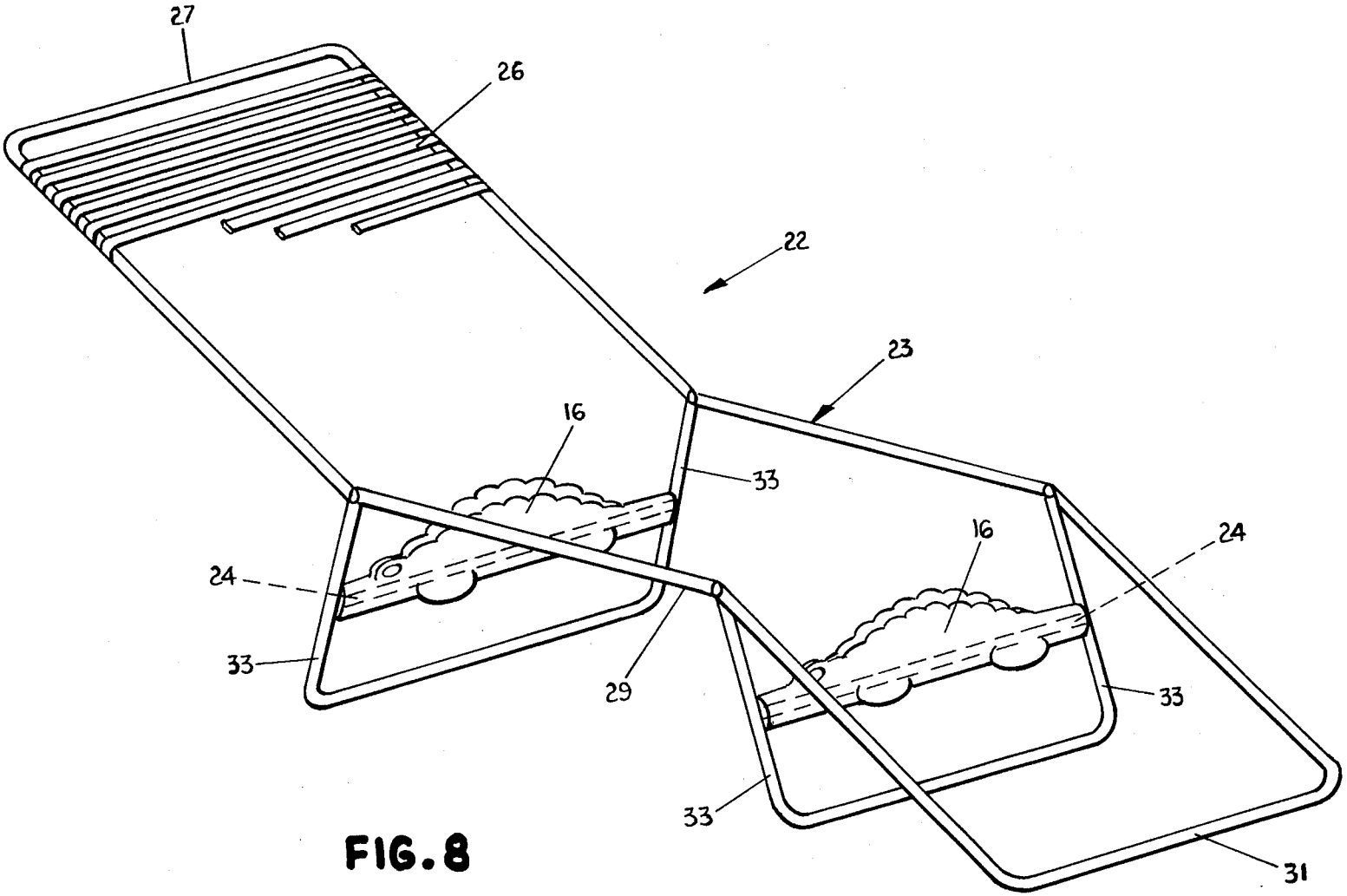
FIG. 8 is a perspective view of a chaise lounge lawn chair with two cushions installed on support ribs.

FIG. 8 shows a preferred embodiment of the present invention as installed on a reclining lawn chair in the form of a chaise lounge 22. Chaise lounge 22 is of conventional design and includes a rigid, folding frame 23 formed of tubular aluminum or the like and a flexible body, supporting material or web 26 suspended on the frame. The material can be fabric or preferably is a flexible tubular plastic material that is currently quite popular. The frame comprises a head section 27, a body section 29 and a foot section 31 that are pivotally connected together, with legs 33 supporting the chair at the junction between the sections. Support ribs 24 extend between the ribs at a position below the flexible body supporting material. When a person rests on the chair in certain positions and at certain elevations of the front and back sections, the person's body causes the flexible material to sag until it comes into proximity to the support ribs. This can be uncomfortable.

The cushion 16 of the present invention is intended to cushion the support ribs, while at the same time enhancing the appearance of the chair. Cushion 16 is placed over supporting ribs 24 and underneath webbing 26. The design of the cushion supplies enough resistance to retain and hold the cushion in place. Cushioning is provided at two points in this particular application, thus relieving contact between the occupant and the supporting rib at approximately the calf area and the lower back area.

Figure 7:
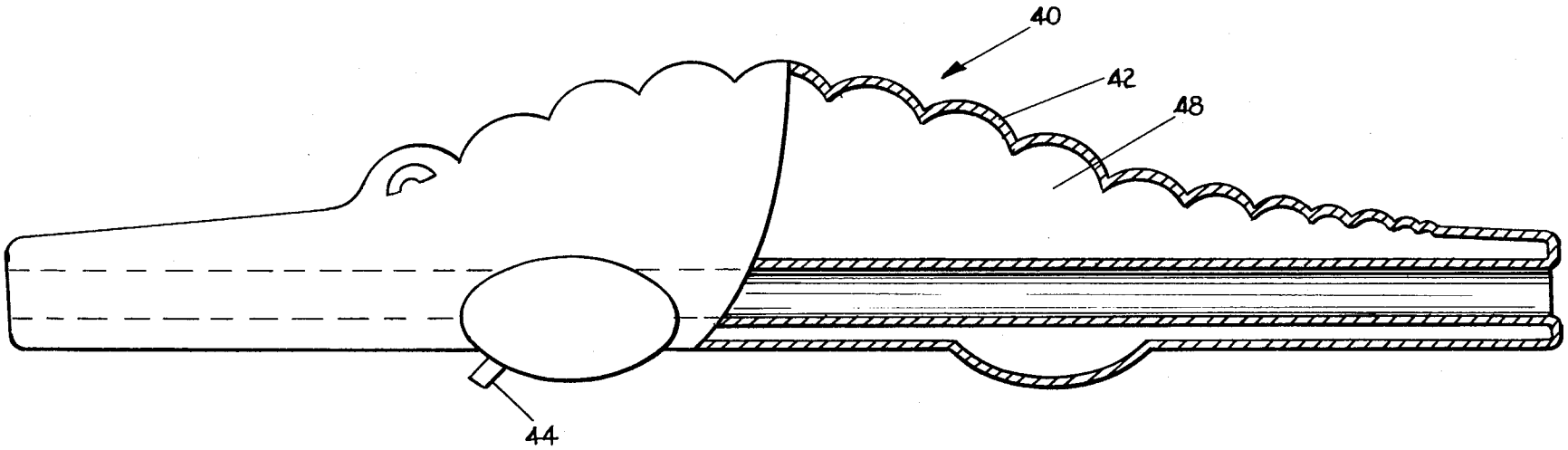
FIG. 7 is a side elevational view of an inflatable rib cushion formed in an alligator likeness.

A third embodiment of the present invention is shown in FIG. 7. In this embodiment, cushion 40 comprises a hollow inflatable body 42, inflated through a valve stem 44. The body can be the same shape as the foam plastic body and have essentially the same features and dimensions.

The materials employed in an inflatable embodiment typically consist of plastic or rubber film or sheet cut to a pre-determined pattern and with seams fused together, so as to form a flexible, airtight envelope with a hollow interior 48.

The flexibility and cushioning of the inflatable version are roughly comparable to that of the molded or sculptured foam version, with the additional advantage of some variability in these properties by increasing or decreasing the amount of inflation. An elastic skin allows the size of the cushion to be adjusted. The cavities formed in this embodiment lack the precision found in the other versions, but compensation for any loss of gripping action can be made by increasing inflation.

The methods of manufacturing inflatable forms are well known in the art and, as such, do not constitute a part of the present invention.

It should be understood that the foregoing embodiments are illustrative of the preferred practice of the present invention. Various modifications or changes may be made without departing from the spirit and scope of the present invention.

The embodiments of the invention in which an exclusive property or privilege is claimed are defined as the following:

1. In a reclining lounge chair comprising a frame having side members and a flexible body support material suspended between the side members, with the frame comprising a central portion having pivoted legs attached to opposite ends thereof and head and leg support portions pivotally attached to the respective ends of the central portion, with rigid transverse support ribs extending across the central portion of the frame at the ends thereof, at or below the level of the central portion of the frame, the flexible body support material being such that the weight of a person lying on the chair can cause the support material to sag to the level of the transverse support rib, causing the rigid transverse support ribs to bear against the body of the user, the improvement comprising a lounge chair rib cushion comprising an elongated body formed of a resiliently yieldable material, an elongated opening formed through the body that is large enough to fit over the support rib, an elongated slot being formed in the side of the cushion that runs the length of the body and leads to the interior opening, such that the rib cushion can be fitted on the rib in a sideways direction through the slot, the portion of the body that is to be adjacent the flexible support material of the lounge chair being sufficiently thick and resilient to provide a soft cushion for the user of the lounge chair.

2. A lounge chair according to claim 1 wherein the cushion comprises an elongated tube formed of a foamed plastic resin or foamed rubber, the walls of the tube being at least 0.01 inches thick.

3. A lounge chair according to claim 1 wherein the slot follows a non-linear path along the length of the cushion such that sideways displacement of the cushion in any direction will produce engagement with at least a portion of the cushion so as to impair inadvertent removal of the cushion from the support rib, the cushion being sufficiently deflectable to permit the user to force the rib through the non-linear slots.

4. A lounge chair according to claim 3 wherein the slot is formed in a saw tooth pattern.

5. A lounge chair according to claim 1 wherein the rib cushion is formed of a foamed polyurethane tubular material having a wall thickness of about 0.250 inches to 3.5 inches and has an internal opening that is slightly larger than the rib that it is to be placed on.

6. A lounge chair according to claim 5 wherein the internal opening in the cushion is about five-eights ($\frac{5}{8}$) inches in diameter and the support rib is about one-half (0.5) inch in diameter.

7. A lounge chair according to claim 1 wherein the outer configuration of the cushion is shaped in the form of an animal.

8. A lounge chair rib cushion according to claim 1 wherein the outer configuration of the cushion is shaped in the form of an alligator or crocodile.

* * * * *